US010041765B2

(12) United States Patent
McMakin

(10) Patent No.: US 10,041,765 B2
(45) Date of Patent: Aug. 7, 2018

(54) CREEP PREVENTING SCOPE MOUNT SYSTEM

(71) Applicant: Ryan McMakin, Lakewood, CO (US)

(72) Inventor: Ryan McMakin, Lakewood, CO (US)

( * ) Notice: Subject to any disclaimer, the term of this patent is extended or adjusted under 35 U.S.C. 154(b) by 0 days.

(21) Appl. No.: 15/009,251

(22) Filed: Jan. 28, 2016

(65) Prior Publication Data

US 2017/0219314 A1 Aug. 3, 2017

(51) Int. Cl.

| | |
|---|---|
| ***F41G 1/387*** | (2006.01) |
| ***F41G 11/00*** | (2006.01) |
| ***F41G 1/38*** | (2006.01) |

(52) U.S. Cl.

CPC ..... *F41G 11/003* (2013.01); *F41G 1/38* (2013.01)

(58) Field of Classification Search

CPC ..... F41G 11/003; F41G 11/001
USPC ..... 42/124–127
See application file for complete search history.

(56) References Cited

U.S. PATENT DOCUMENTS

| | | | | |
|---|---|---|---|---|
| 960,813 | A | 6/1910 | Frank | |
| 2,548,031 | A | 4/1951 | Marcus | |
| 2,583,260 | A | 1/1952 | Felix | |
| 2,585,985 | A | 2/1952 | Anderson | |
| 2,649,779 | A | 8/1953 | Hardgrove | |
| 2,743,525 | A | 5/1956 | Marcus | |
| 3,045,351 | A | 7/1962 | Dayton | |
| 3,187,435 | A | 6/1965 | Miller | |
| 3,235,967 | A * | 2/1966 | Moure | F41G 11/003 42/122 |
| 3,559,940 | A | 2/1971 | Kruzell | |
| 3,750,318 | A | 8/1973 | Burris | |
| 3,818,577 | A | 6/1974 | Bailey et al. | |
| 3,835,565 | A | 9/1974 | Weast | |
| 3,875,675 | A | 4/1975 | Krisay | |
| 4,205,473 | A | 6/1980 | Wilson | |
| 4,216,600 | A | 8/1980 | Brueckner et al. | |
| 4,446,644 | A | 5/1984 | Jimenez et al. | |
| 4,569,109 | A | 2/1986 | Fetouh | |
| 4,756,111 | A | 7/1988 | Lapier | |

(Continued)

FOREIGN PATENT DOCUMENTS

| | | |
|---|---|---|
| EP | 1721116 B1 | 12/2013 |
| JP | S 5821017 A | 2/1983 |

OTHER PUBLICATIONS

"SAKO OPTILOCK TM" printed from http://www.sako.fi/scope-mounts on Apr. 13, 2016, 6 pages.

*Primary Examiner* — Michael D David
(74) *Attorney, Agent, or Firm* — Trenner Law Firm, LLC; Mark D. Trenner

(57) ABSTRACT

A scope mount and mounting system is disclosed. An example scope mount includes at least one ring mount to receive a scope body. The ring mount has an upper ring and a lower ring. The example scope mount also includes mating interface surfaces between the upper ring and the lower ring. In an example, the mating interface surfaces are cracked. In another example, the mating interface surfaces are precision machined. The example scope mount also includes a pliable insert having a spherical outer body to fit within the ring mount and secure the scope body between the upper ring and the lower ring while accommodating misalignment of the scope body within the ring mount. The example scope mount also includes a rail lock to secure the ring mount in both axes on a rail of a firearm.

3 Claims, 10 Drawing Sheets

(56) References Cited

U.S. PATENT DOCUMENTS 4,860,419 A 8/1989 Hekman
4,941,277 A * 7/1990 Lawlor ..... F41G 11/003 42/111
5,086,566 A * 2/1992 Klumpp ..... F41G 11/003 42/126
5,105,538 A 4/1992 Hoag et al.
5,283,938 A 2/1994 Jones
5,315,781 A 5/1994 Beisner
5,425,191 A * 6/1995 Taylor ..... F41G 11/001 42/124
5,669,173 A 9/1997 Rodney
5,787,630 A 8/1998 Martel
5,926,964 A 7/1999 Korapaty
6,283,644 B1 * 9/2001 Gilliland ..... G02B 6/4204 385/88
6,337,773 B1 * 1/2002 Kawano ..... G02B 17/0848 359/642
6,578,748 B2 6/2003 Matsuoka et al.
6,598,333 B1 * 7/2003 Randazzo ..... F41G 11/003 42/124
6,629,381 B1 * 10/2003 Keng ..... F41G 11/003 42/124
6,701,660 B2 3/2004 Stover
7,125,190 B2 10/2006 England
7,272,904 B2 * 9/2007 Larue ..... F41G 11/003 292/145
7,444,776 B2 * 11/2008 Adams ..... F41G 11/001 42/124
7,563,097 B2 * 7/2009 Lavigna ..... F41C 23/16 42/124
7,730,655 B2 6/2010 Spuhr
7,971,384 B2 6/2011 Lippard
8,136,287 B2 * 3/2012 Adams ..... F41G 11/001 403/325
8,312,667 B2 11/2012 Thomas et al.
8,683,732 B2 4/2014 Joplin
9,453,707 B2 * 9/2016 Williams ..... F41G 1/387
D777,289 S * 1/2017 Cheng ..... D22/109
2007/0175079 A1 * 8/2007 Epling ..... F41G 11/001 42/124
2007/0266611 A1 11/2007 Stover
2008/0022576 A1 1/2008 Epling
2009/0250859 A1 10/2009 Okumura
2010/0024276 A1 2/2010 Kellis

* cited by examiner

CREEP PREVENTING SCOPE MOUNT SYSTEM

BACKGROUND

A scope is a sighting device, typically providing optical magnification to enable accurate aim. Scopes may be equipped with a reticle (e.g., graphic image pattern such as "cross-hairs"). Scopes may be provided on anything that requires accurate aim. Typically, scopes are provided on rifles or other firearms. The scope may be mounted to the rifle or other firearm in an optically appropriate position, such as over the barrel of the firearm.

Scopes may be mounted with one or more scope "ring." For example, a single ring may be used to mount a scope on a handgun, rim fire rifle, or other low-recoil firearm. Typically, however, scopes are mounted to the firearm by two rings (e.g., a first ring in the front and a second ring in the back of the scope). High-recoil firearms, may even use three rings to mount a scope. The number and positioning of rings depends at least to some extent on the amount recoil of the firearm, and may be selected to reduce the amount of torque on the scope tube.

Regardless of the number of scope rings, however, most scopes will eventually suffer from scope "creep." Scope creep is caused by inertia of the scope under recoil of the firearm. Over time, the scope actually shifts in position and thus is no longer accurate for sighting. To reduce scope creep, scope rings must be precisely fitted to the scope. Even then, the scope mounts have to be consistently tightened to provide maximum securement, without causing uneven stress on the body of the scope. Rings that are out of round, misaligned in the bases, or tightened unevenly can warp or crush the body of the scope.

DETAILED DESCRIPTION

A scope mount is disclosed herein which reduces scope creep, provides maximum securement without causing uneven stress on the body of the scope. The scope mount also reduces misaligned bases and uneven tightening of the scope to the mount.

An example scope mount includes a lower ring and an upper ring. The example scope mount also includes an interface on the lower ring, and a mating interface on the upper ring. In an example, the interface is formed by cracking the upper ring from the lower ring. In another example, the interface is precision machined.

The example scope mount also includes an insert configured to fit between the lower ring and the upper ring. In an example, the insert is a precision-molded, high-temperature silicone ring. The insert may have a spherical outer body so that the insert can be fittingly retained in the ring mount. The insert may provide clamping and frictional forces on the scope body. The insert may also be pliable and accommodate misalignment of the scope body within the ring mount.

The example scope mount also includes a rail lock to mount on a mounting rail of a firearm. In an example, the rail lock includes a locating bar to contact a crossbar of the mounting rail. The rail lock also includes an adjustable tab on the lower ring to sandwich the cross bar of the mounting rail. The rail lock secures the lower ring in both axis on the mounting rail.

The scope mount disclosed herein addresses multiple problems associated with other scope ring designs. In an example, the scope mount eliminates crimping, scratches, pressure points, bending, and optical deflections caused by even the slightest misalignment of the rings on the rail or mounts. The scope mount disclosed herein also eliminates any gap between the scope ring halves, and removes the shear stresses from the scope ring fasteners. The rail lock adds extra stability to the base.

Before continuing, it is noted that as used herein, the terms "includes" and "including" mean, but is not limited to, "includes" or "including" and "includes at least" or "including at least" The term "based on" means "based on" and "based at least in part on."

Figure 1A:
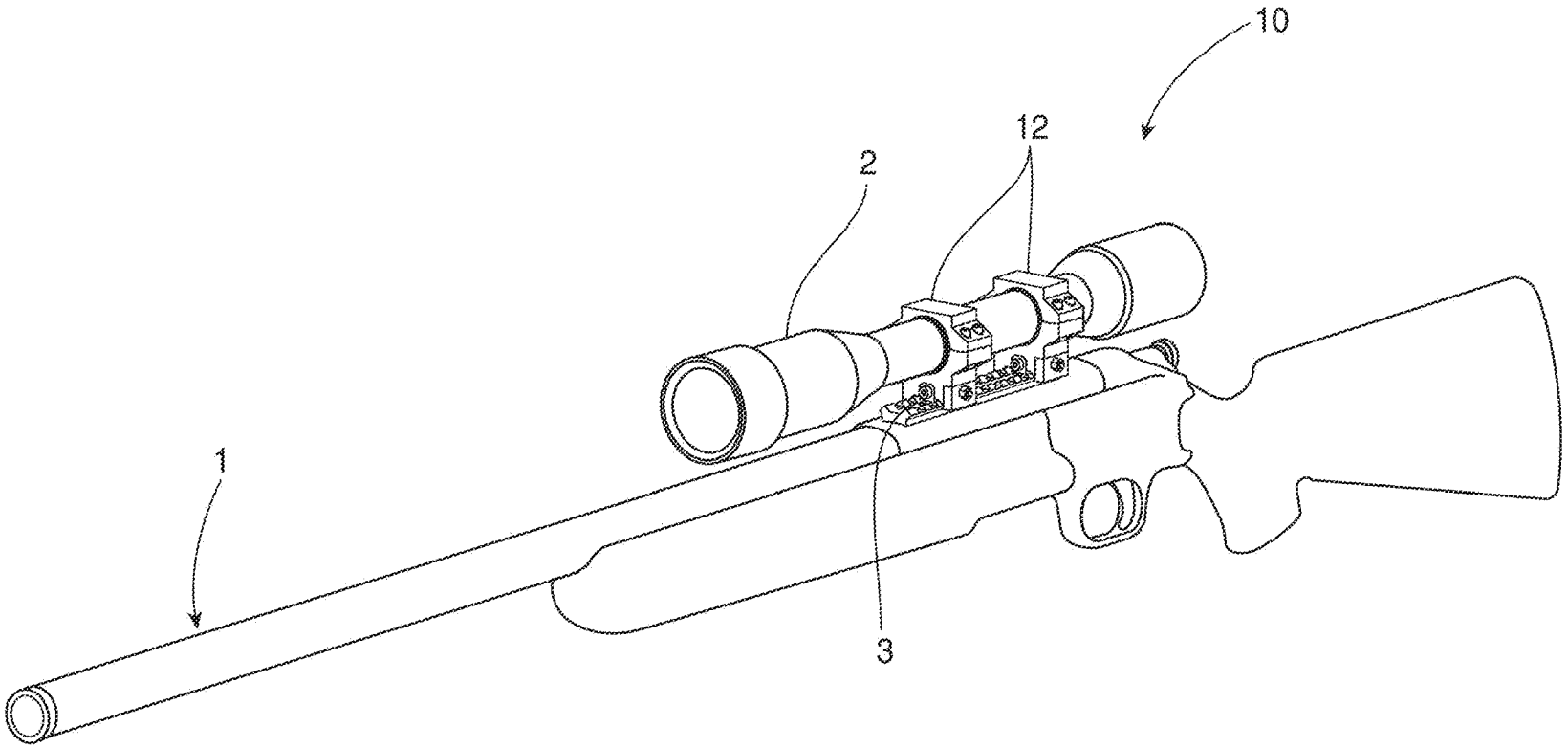
FIGS. 1A-B show an example scope mount as it may be mounted on a rifle.
Figure 1B:
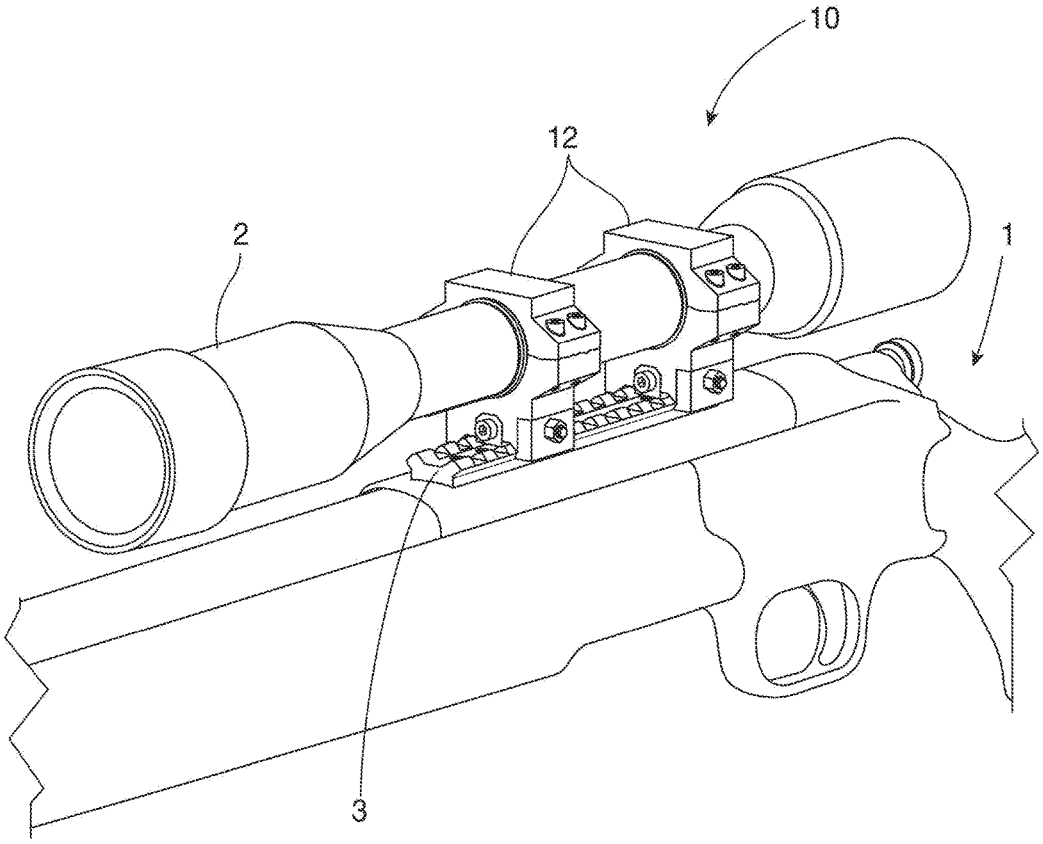

FIGS. 1A-B show an example scope mount 10 as it may be mounted on a rifle 1. The scope mount 10 may have one or more ring mount 12 to receive a scope body 2. In FIGS. 1A-B, the scope mount 10 is shown as it may include two ring mounts 12.

The ring mount 12 may be manufactured of any suitable material. In an example, the ring mount 12 is made of an extremely strong, forged metal that can endure even the heaviest recoiling firearm. The ring mount 12 may be configured such that the entire body of the ring mount 12 absorbs the brunt force of the recoil.

Before continuing, it should be noted that the examples described above are provided for purposes of illustration, and are not intended to be limiting. Other devices and/or device configurations may be utilized to carry out the operations described herein. In addition, the scope mount 10 may be used with any suitable firearm. The scope mount 10 may have other applications not described herein, such as but not limited to, telescopes and other optics.

Figure 2A:
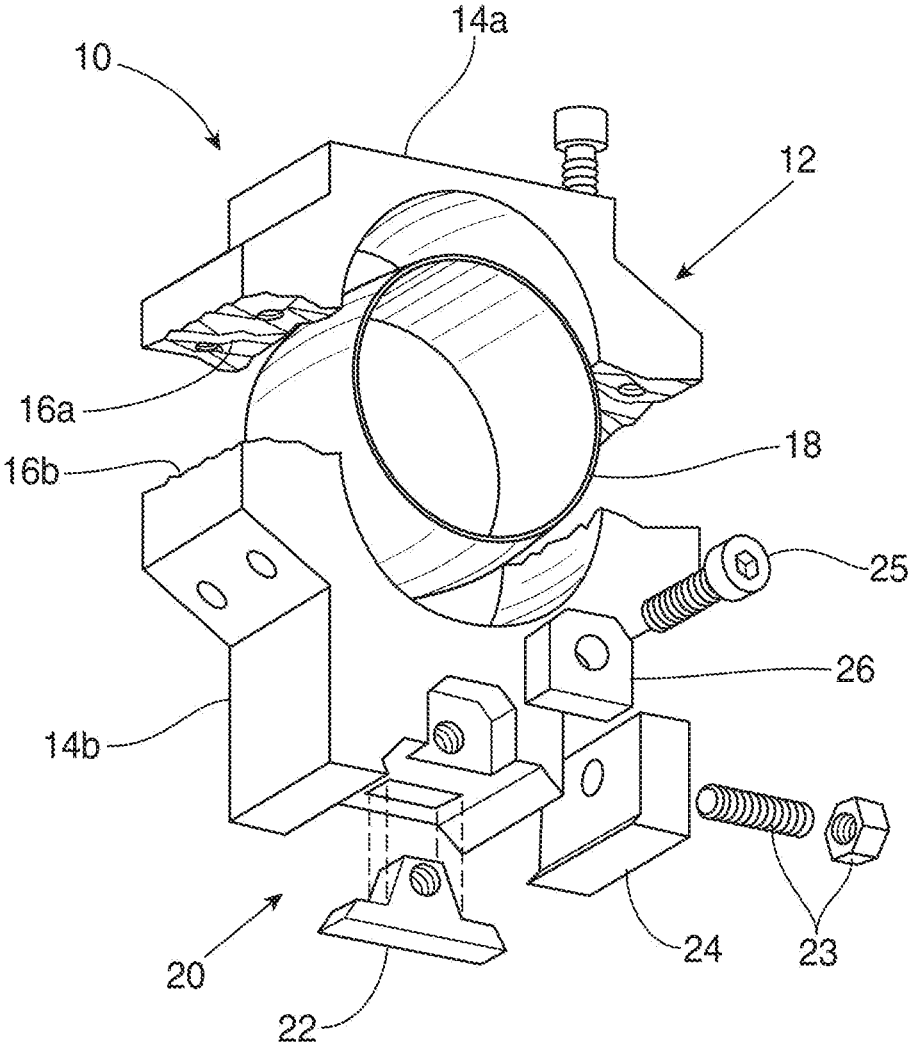
FIG. 2A is an exploded view of an example scope mount.
Figure 2B:
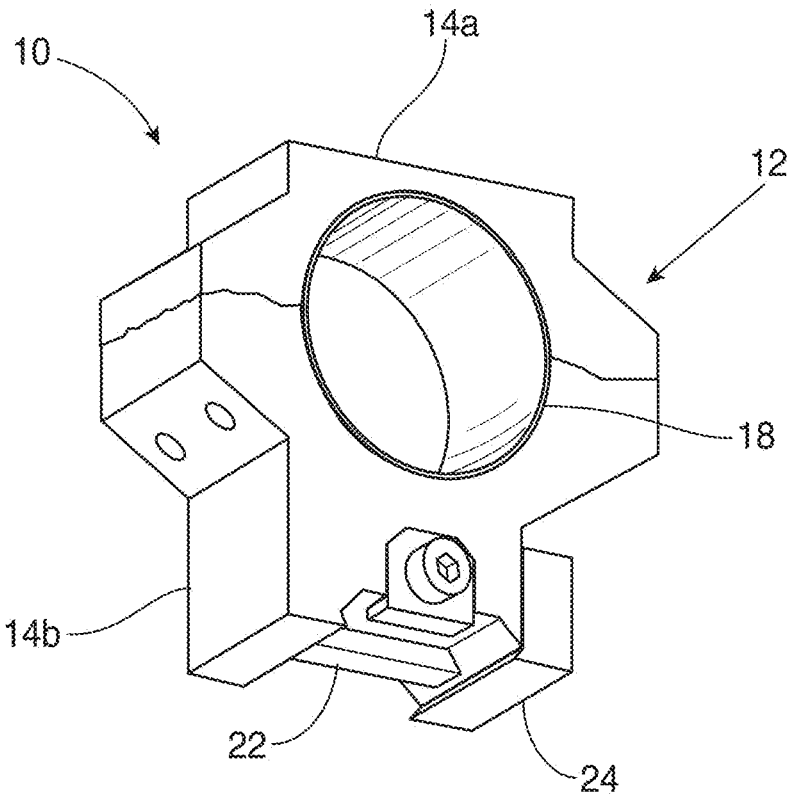
FIG. 2B is an assembled view of the example scope mount shown in FIG. 2A.

FIG. 2A is an exploded view of an example scope mount 10. FIG. 2B is an assembled view of the example scope mount shown in FIG. 2A. The ring mount 12 is shown as it may have an upper ring portion 14*a* and a lower ring portion 14*b*. The ring mount 12 has mating interface surfaces 16*a* and 16*b* between the upper ring portion 14*a* and the lower ring portion 14*b*, respectively.

In the example shown in FIGS. 2A-B, the ring mount 12 is forged as a single piece and mechanically cracked. The ring mount 12 may be fully machined (e.g., including holes, threads, and cuts) before the ring mount 12 is mechanically cracked to separate the two ring portions 14*a* and 14*b*, forming a mechanically perfect interfacing fit between the two ring portions 14*a* and 14*b*.

The mechanical cracking results in there being no gap between the interfaces 16*a* and 16*b* of the two ring portions 14*a* and 14*b* after assembly. As such, there is no shear stress on the ring fasteners 13. That is, the cracked surfaces 16*a* and 16*b* retain the two ring portions 14*a* and 14*b* against sliding. This reduces or altogether eliminates breakage of the fasteners 13 due to shear forces.

The example scope mount 10 also includes an insert 18. The insert 18 may have a spherical outer body and may fit within the spherical inner body of the ring mount 12. As such, the insert 18 secures the scope body 2 between the upper ring portion 14*a* and the lower ring portion 14*b*. The insert 18 may also accommodate misalignment of the scope body 2. That is, the scope body 2 does not have to be perfectly aligned within the ring mount 12. In addition, two or more ring mounts do not have to be concentrically aligned with one another, and the scope body 2 can still be optically aligned with the barrel of the firearm.

In an example, the insert 16 is pliable. For example, the insert 16 may be a precision molded, high temperature Silicone (or other pliable material) that surrounds and isolates the optical tube of a scope body 2. The spherical outer body of the insert 16 accommodates misalignment of the ring mount 12 (e.g., relative to another ring mount 12), without affecting the scope body 2 alignment (e.g., without causing deflection of the scope body 2).

The spherical outer body of the insert 16 also provides an even clamping force on the scope body 2. As such, the insert 16 reduces or altogether eliminates movement of the scope body 2. This assists in retaining accurate alignment of the scope body 2 during assembly and/or use, and reduces or altogether eliminates damage to the scope body 2 (and scope optical assembly) during mounting and/or use. The insert 16 may further enable higher clamping and frictional forces on the scope body 2.

Figure 3:
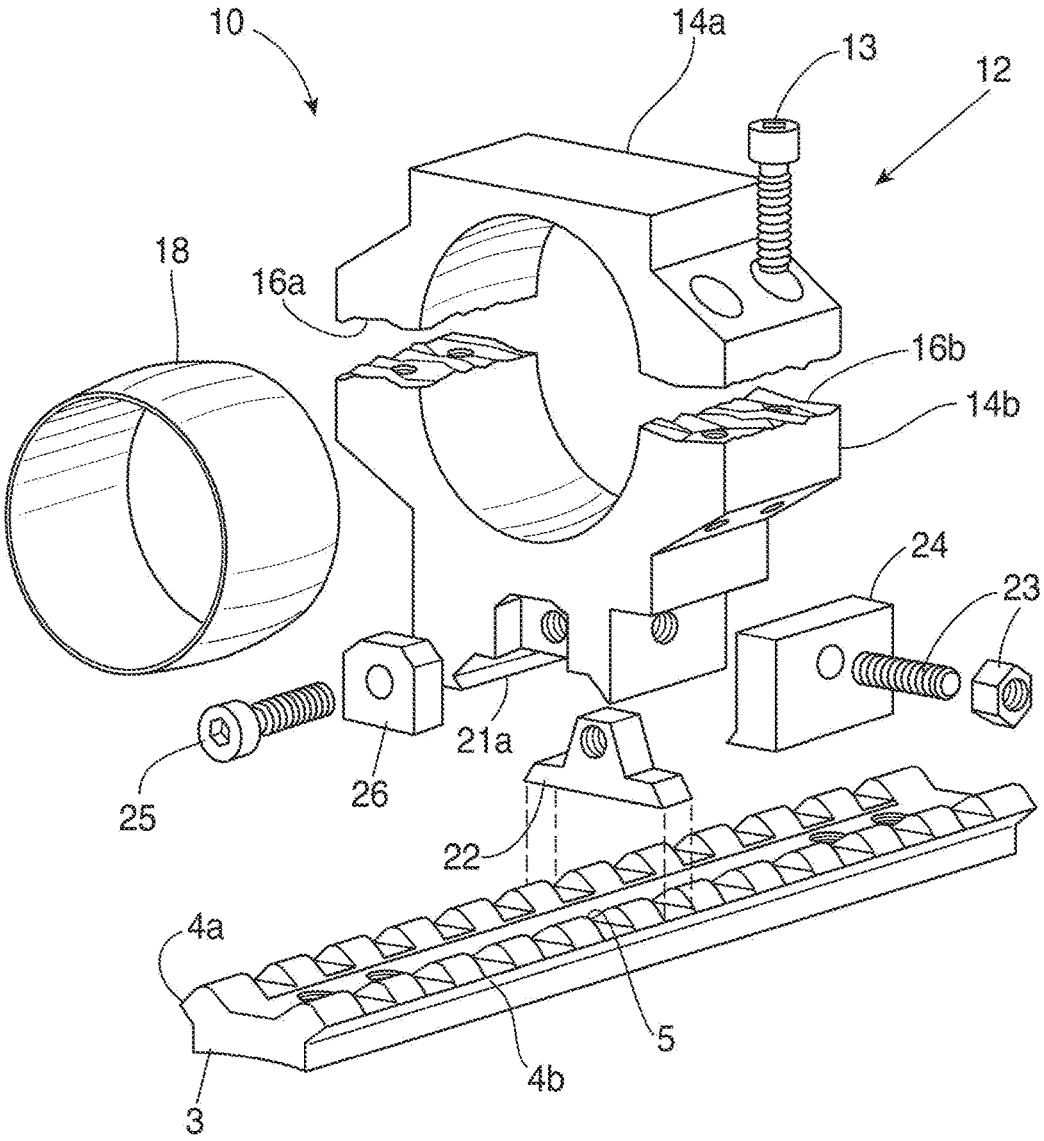
FIG. 3 is another exploded view of the example scope mount shown in FIG. 2A.
Figure 4:
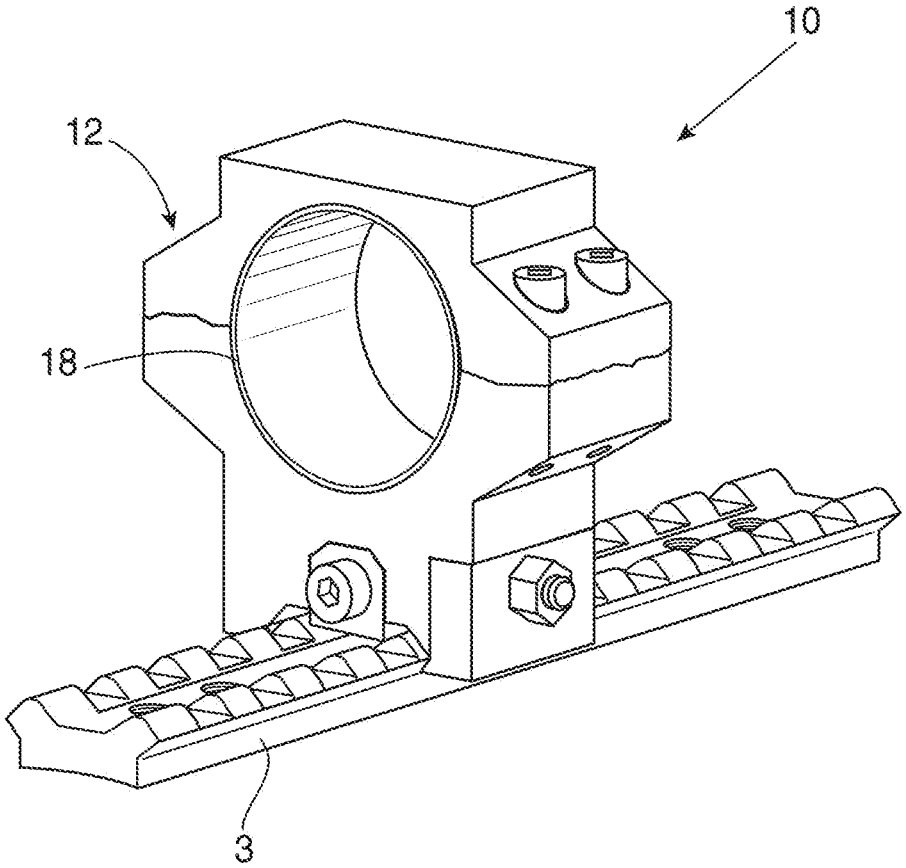
FIG. 4 is an assembled view of the example scope mount shown in FIG. 2A.

FIG. 3 is another exploded view of the example scope mount 10. FIG. 4 is an assembled view of the example scope mount 10. In an example, the scope mount 10 includes a rail lock 20 to secure the ring mount 12 in both axes on a rail 3 of a firearm 1. In the example shown, the rail 3 is a Weaver or Picatinny-style rail. However, the scope mount 10 may also be configured for use with other types of rails as will be readily understood by those having ordinary skill in the art after becoming familiar with the teachings herein.

The rail lock 20 may include a substantially V-shaped edge 21*a*, and another V-shaped edge formed by the combination of edge 21*b* and edge 21*c*, The V-shaped edges engage the edges 4*a* and 4*b* of the rail 3.

In an example, the rail lock 20 includes an adjustable tab 22 and fastener 23 on a side of the lower ring portion 14*b*, It is noted that the adjustable tab 22 may be provided on either (or both) sides of the lower ring portion 14*b*. The adjustable tab 22 tightens the rail lock 20 on the outer edges 4*a* and 4*b* of the mounting rail 3 to secure the ring mount 20 along a first axis. That is, the adjustable tab 22 secures the ring mount 12 against side-to-side movement across the width of the rail 3.

In an example, the rail lock 20 includes a locating bar 24. The locating bar 24 may be inserted into the lower ring portion 14*b* and secured by a tab 26 and fastener 25. The locating bar 22 is inserted between adjacent cross bars 5 of the mounting rail 3. As such, the locating bar 24 secures the ring mount 20 along a second axis. That is, the locating bar 24 secures the ring mount 12 against front-to-back movement along the length of the rail 3.

Together, the locating bar 22 and adjustable tab 24 of the rail lock 20 secure the lower ring portion 14*b* of the ring mount 12 along both axes of the mounting rail 3. That is, the rail lock secures the ring mount 12 against front-to-back movement, and against side-to-side movement.

Figure 5A:
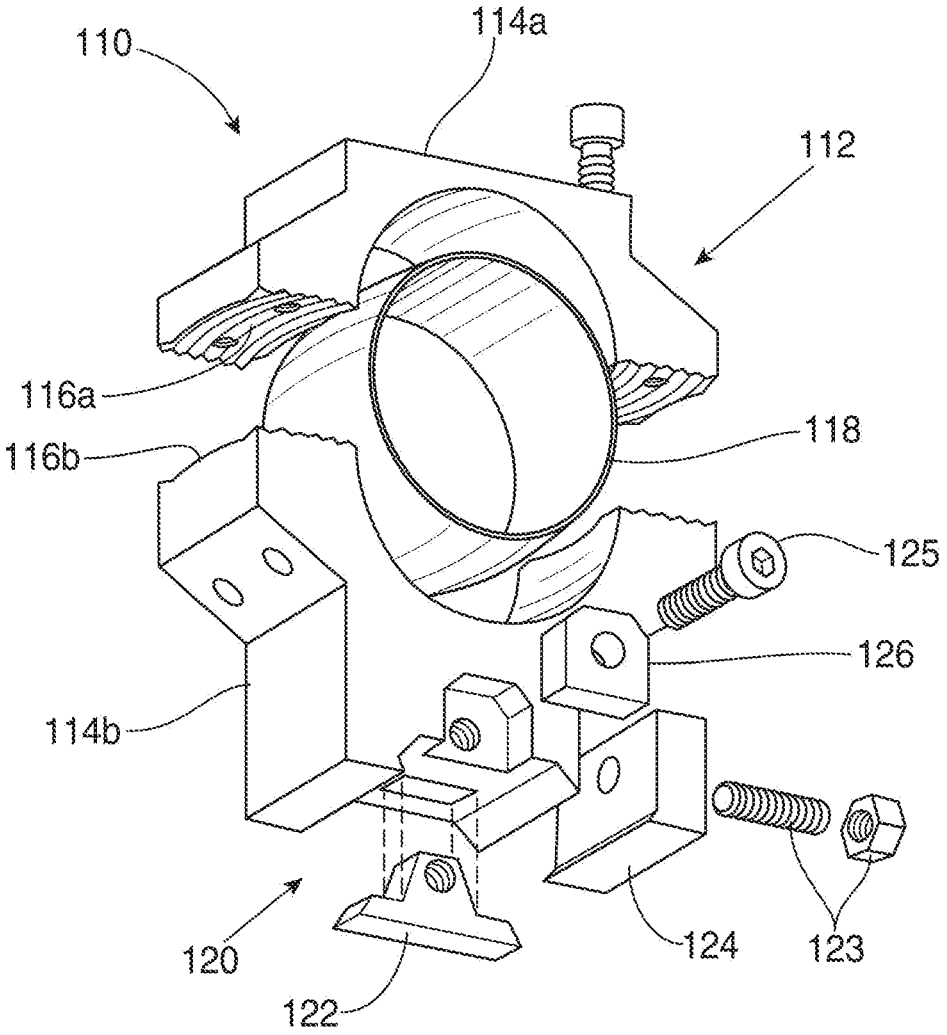
FIG. 5A is an exploded view of another example scope mount.
Figure 5B:
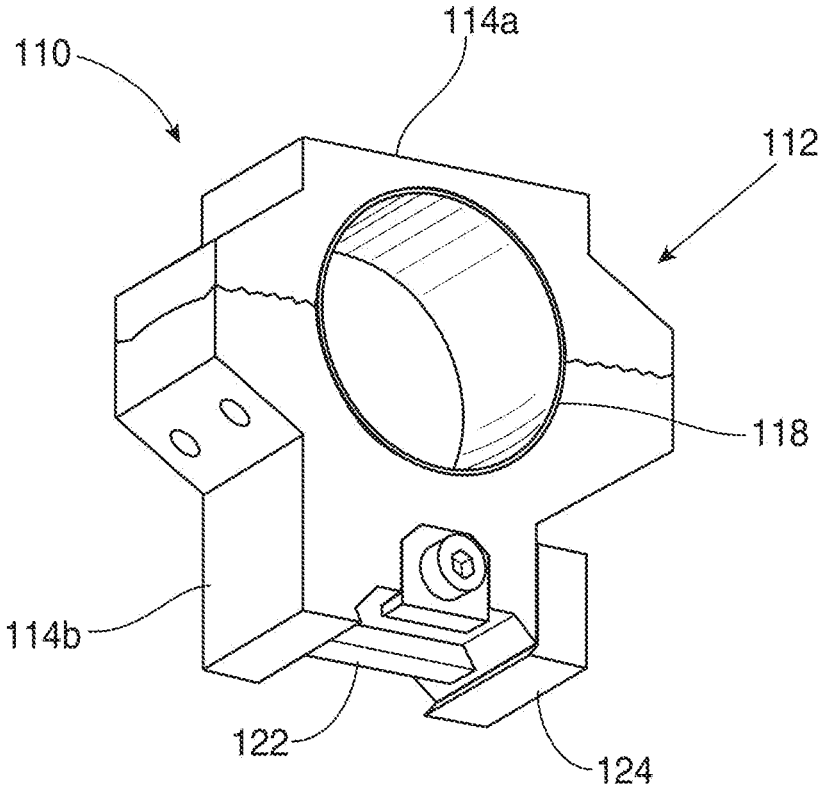
FIG. 5B is an assembled view of the example scope mount shown in FIG. 5A.

FIG. 5A is an exploded view of another example scope mount 110. FIG. 5B is an assembled view of the example scope mount shown in FIG. 5A. Similar components are described with reference to FIGS. 5-7 by 100-series reference numbers, even if those components are not described again.

The example scope mount 110 also includes one or more ring mount 112. The ring mount 112 is shown as it may have an upper ring portion 114*a* and a lower ring portion 114*b*. The ring mount 112 has mating interface surfaces 116*a* and 116*b* between the upper ring portion 114*a* and the lower ring portion 114*b*, respectively.

In the example shown in FIGS. 5A-B, the two ring portions 114*a* and 114*b* are precision machined, forming a mechanically perfect interfacing fit between the two ring portions 114*a* and 114*b*. As such, there is no gap between the interfaces 116*a* and 116*b* of the two ring portions 114*a* and 114*b* after assembly. There is no shear stress on the fasteners. That is, the machined surfaces 116*a* and 116*b* retain the two ring portions 114*a* and 114*b* against sliding. This reduces or altogether eliminates breakage of the fasteners due to shear forces.

The example scope mount 110 also includes an insert 118. The insert 118 may have a spherical outer body and may fit within the spherical inner body of the ring mount 112. As such, the insert 18 secures the scope body 2 between the upper ring portion 114*a* and the lower ring portion 114*b*. The insert 118 may also accommodate misalignment of the scope body 2 (e.g., between two or more ring mounts) within the ring mount 112.

In an example, the insert 116 is pliable. For example, the insert 116 may be a precision molded, high temperature Silicone (or other pliable material) that surrounds and isolates the optical tube of a scope body 2. The spherical outer body of the insert 116 accommodates misalignment of the ring mount 112 (e.g., relative to another ring mount 112), without affecting the scope body 2 alignment (e.g., without causing deflection of the scope body 2).

The spherical outer body of the insert 116 also provides an even clamping force on the scope body 2. As such, the insert 116 reduces or altogether eliminates movement of the scope body 2. This assists in retaining accurate alignment of the scope body 2 during assembly and/or use, and reduces or altogether eliminates damage to the scope body 2 (and scope optical assembly) during mounting and/or use. The insert 116 may further enable higher clamping and frictional forces on the scope body 2.

Figure 6:
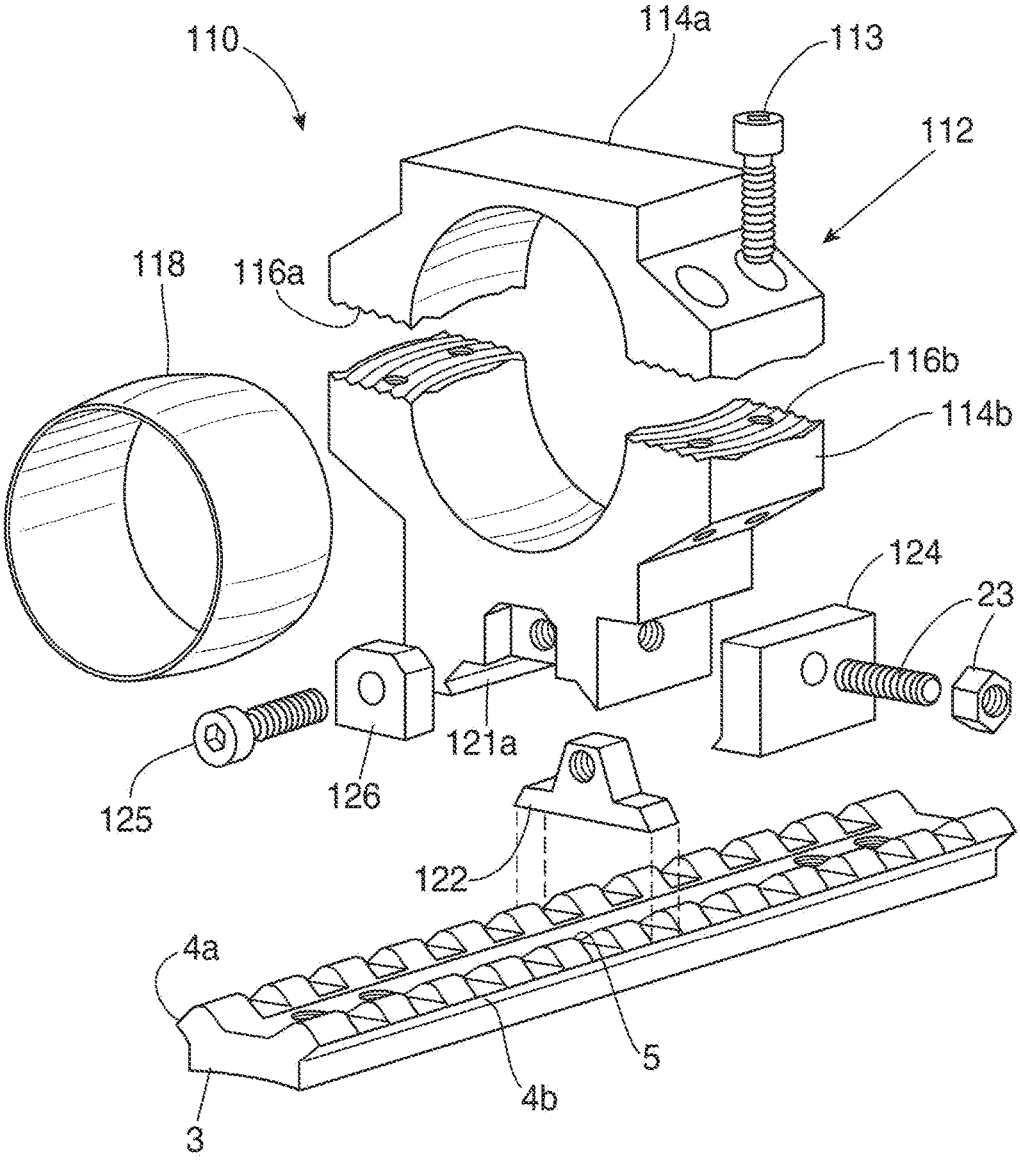
FIG. 6 is another exploded view of the example scope mount shown in FIG. 5A.
Figure 7:
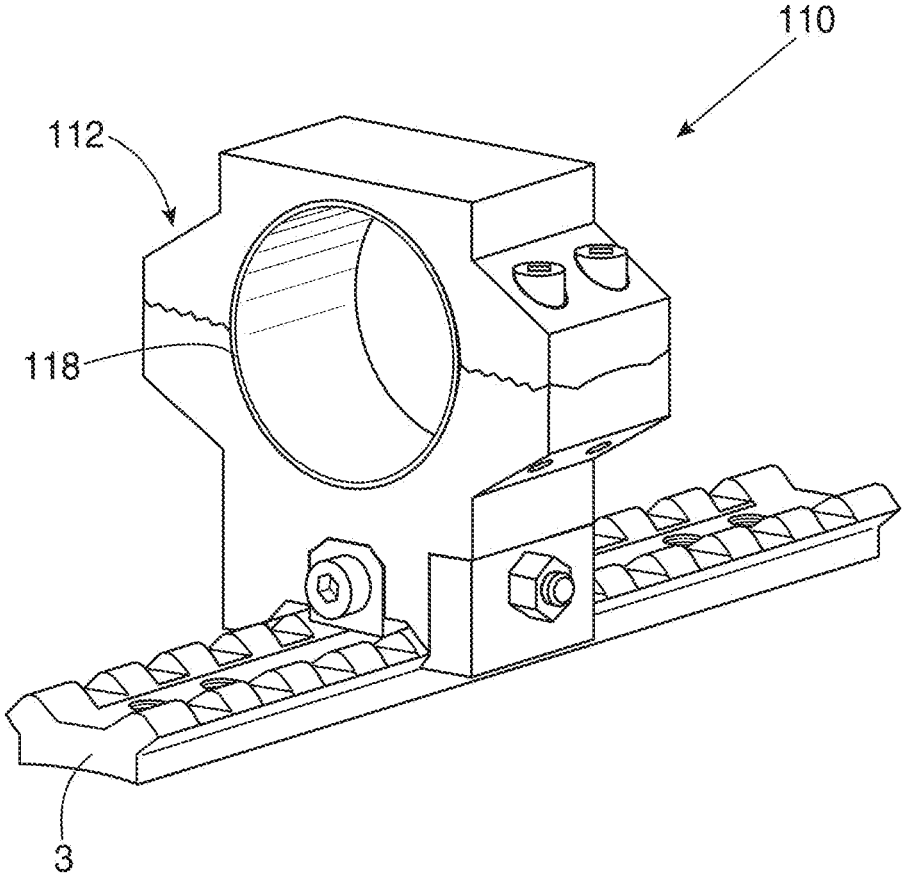
FIG. 7 is an assembled view of the example scope mount shown in FIG. 5A.

FIGS. 6-7 illustrate assembly of the example scope mount shown in FIGS. 5A-B. FIG. 6 is another exploded view of the example scope mount. FIG. 7 is an assembled view of the example scope mount.

In an example, the scope mount 110 includes a rail lock 120 to secure the ring mount 112 in both axes on a rail 3 of a firearm 1. In the example shown, the rail 3 is a Weaver or Picatinny-style rail. However, the scope mount 110 may also be configured for use with other types of rails as will be readily understood by those having ordinary skill in the art after becoming familiar with the teachings herein.

The rail lock 120 may include a substantially V-shaped edge 121*a*, and another V-shaped edge formed by the combination of edge 121*b* and edge 121*c*. The V-shaped edges engage the edges 4*a* and 4*b* of the rail 3.

In an example, the rail lock 120 includes an adjustable tab 122 and fastener 123 on a side of the lower ring portion 114*b*. It is noted that the adjustable tab 122 may be provided on either (or both) sides of the lower ring portion 114*b*. The adjustable tab 122 tightens the rail lock 120 on the outer edges 4*a* and 4*b* of the mounting rail 3 to secure the ring mount 120 along a first axis. That is, the adjustable tab 122 secures the ring mount 112 against side-to-side movement across the width of the rail 3.

In an example, the rail lock 120 includes a locating bar 124. The locating bar 124 may be inserted into the lower ring portion 114*b* and secured by a tab 126 and fastener 125. The locating bar 122 is inserted between adjacent cross bars 5 of the mounting rail 3. As such, the locating bar 124 secures the ring mount 120 along a second axis. That is, the locating bar 124 secures the ring mount 112 against front-to-back movement along the length of the rail 3.

Together, the locating bar 122 and adjustable tab 124 of the rail lock 120 secure the lower ring portion 114*b* of the ring mount 112 along both axes of the mounting rail 3. That is, the rail lock secures the ring mount 112 against front-to-back movement, and against side-to-side movement.

It is noted that the examples shown and described are provided for purposes of illustration and are not intended to be limiting. Still other examples are also contemplated.

The invention claimed is:

1. A scope mount, comprising:

a ring mount having a lower ring and an upper ring forged as a single piece and mechanically cracked to form a mechanically perfect interfacing fit between the lower ring and the upper ring, wherein the interfacing fit retains the lower ring and the upper ring in position against shear forces in any direction;

a precision molded insert configured to fit between the lower ring and the upper ring, the precision molded insert having a spherical outer body to fit within a spherical inner body of the ring mount to secure a scope body between the upper ring and the lower ring, the precision molded insert accommodating misalignment of the scope body within the ring mount; and a rail lock configured to mount on a mounting rail of a firearm, the rail lock having a locating bar inserted into the lower ring and secured by an adjustable tab, the rail lock contacting a crossbar of the mounting rail and the adjustable tab on the lower ring to sandwich the crossbar of the mounting rail, wherein the rail lock secures the lower ring in two axes on the mounting rail to prevent front-to-back movement and side-to-side movement.

2. A scope mount, comprising:

a ring mount to receive a scope body, the ring mount having mating interface surfaces from the ring mount forged as a single piece and mechanically cracked, wherein the mating interface surfaces form a mechanically perfect interfacing fit between the lower ring and the upper ring, wherein the mating interface surfaces retains the ring mount in position against shear forces in any direction;

a precision molded pliable insert to fit within the ring mount and secure the scope body, the precision molded pliable insert having a spherical outer body to fit within a spherical inner body of the ring mount to secure the scope body in the ring mount, the precision molded pliable insert accommodating misalignment of the scope body within the ring mount; and a rail lock to secure the ring mount in two axes on a rail of a firearm, the ring mount configured to mount on a mounting rail of the firearm, the rail lock having a locating bar secured by an adjustable tab on the ring mount, the rail lock contacting a crossbar of the mounting rail and the adjustable tab on the ring mount to sandwich the crossbar of the mounting rail, wherein the rail lock secures the ring mount in two axes on the mounting rail to prevent front-to-back movement and side-to-side movement.

3. A scope mounting system, comprising:

at least one ring mount to receive a scope body, the ring mount having an upper ring and a lower ring forged as a single piece and mechanically cracked to form a mechanically perfect interfacing fit between the lower ring and the upper ring, wherein the interfacing fit retains the lower ring and the upper ring in position against shear forces in any direction;

a precision molded pliable insert having a spherical outer body to fit within a spherical inner body of the ring mount and secure the scope body between the upper ring and the lower ring while accommodating misalignment of the scope body within the ring mount; and a rail lock to secure the ring mount in two axes on a rail of a firearm, the rail lock having a locating bar inserted into the lower ring and secured by an adjustable tab, the rail lock contacting a crossbar of the mounting rail and the adjustable tab on the lower ring to sandwich the crossbar of the mounting rail, wherein the rail lock secures the lower ring in two axes on the mounting rail to prevent front-to-back movement and side-to-side movement.

* * * * *